US006689244B2

(12) United States Patent
Schwertfeger

(10) Patent No.: US 6,689,244 B2
(45) Date of Patent: Feb. 10, 2004

(54) DOUBLE SIDED ADHESIVE TAPE FOR SEALING AND OPENING CARTONS OR CARTONLIKE PACKAGES

(75) Inventor: Michael Schwertfeger, Hamburg (DE)

(73) Assignee: tesa AG, Hamburg (DE)

( * ) Notice: Subject to any disclaimer, the term of this patent is extended or adjusted under 35 U.S.C. 154(b) by 0 days.

(21) Appl. No.: 10/154,676

(22) Filed: May 23, 2002

(65) Prior Publication Data

US 2003/0041964 A1 Mar. 6, 2003

(30) Foreign Application Priority Data

Aug. 4, 2001 (DE) ..... 101 38 350

(51) Int. Cl.[7] ..... B32B 33/00; B65B 7/16

(52) U.S. Cl. ..... 156/247; 156/289; 53/375.8; 53/376.3; 53/484

(58) Field of Search ..... 53/375.8, 376.3, 53/484, 485; 156/69, 247, 249, 256, 289, 323

(56) References Cited

U.S. PATENT DOCUMENTS

| | | | | |
|---|---|---|---|---|
| 1,724,648 A | | 8/1929 | Fellowes | |
| 4,026,754 A | * | 5/1977 | Bogdanski et al. | 156/521 |
| 4,386,705 A | | 6/1983 | Meuller | 206/626 |
| 4,622,260 A | | 11/1986 | Tesch | 428/173 |
| 4,869,769 A | | 9/1989 | DiRusso, Jr. | 156/269 |
| 5,439,101 A | * | 8/1995 | Brink et al. | 206/45.24 |
| 6,041,998 A | * | 3/2000 | Goldberg | 229/193 |

FOREIGN PATENT DOCUMENTS

| | | |
|---|---|---|
| CH | 690574 | 10/2000 |
| DE | 10 06 786 B | 9/1954 |
| DE | 82 16 242 U1 | 9/1982 |
| DE | 87 04 633 U1 | 5/1987 |
| DE | 30 21 989 B1 | 6/1987 |
| DE | 43 13 008 C1 | 11/1994 |
| EP | 0 578 151 A1 | 1/1994 |
| EP | 0795480 | 9/1997 |
| FR | 2733203 | 10/1996 |
| FR | 2795480 | 12/2000 |

OTHER PUBLICATIONS

Abstract of FR 2795480 from EPO website database.
Abstract of CH 690574 from EPO website database.
Abstract of EP 0795480 from EPO website database.
Abstract of FR 2733203 from EPO website database.

* cited by examiner

*Primary Examiner*—Richard Crispino
*Assistant Examiner*—Sing P. Chan
(74) *Attorney, Agent, or Firm*—Norris McLaughlin & Marcus, P.A.

(57) ABSTRACT

Method of using a double sided adhesive tape for sealing and opening cartons or cartonlike packages, at least one of the two films of adhesive being provided with a nontacky covering, which for sticking the adhesive tape between overlapping plies or flaps is removed partially from the adhesive layer, the bonding of the adhesive tape between the overlapping plies or flaps of the carton or of the cartonlike package taking place in such a way that the part of the covering which has not been removed from the film of adhesive is likewise situated between the overlapping plies or flaps.

15 Claims, 3 Drawing Sheets

Figure 1:
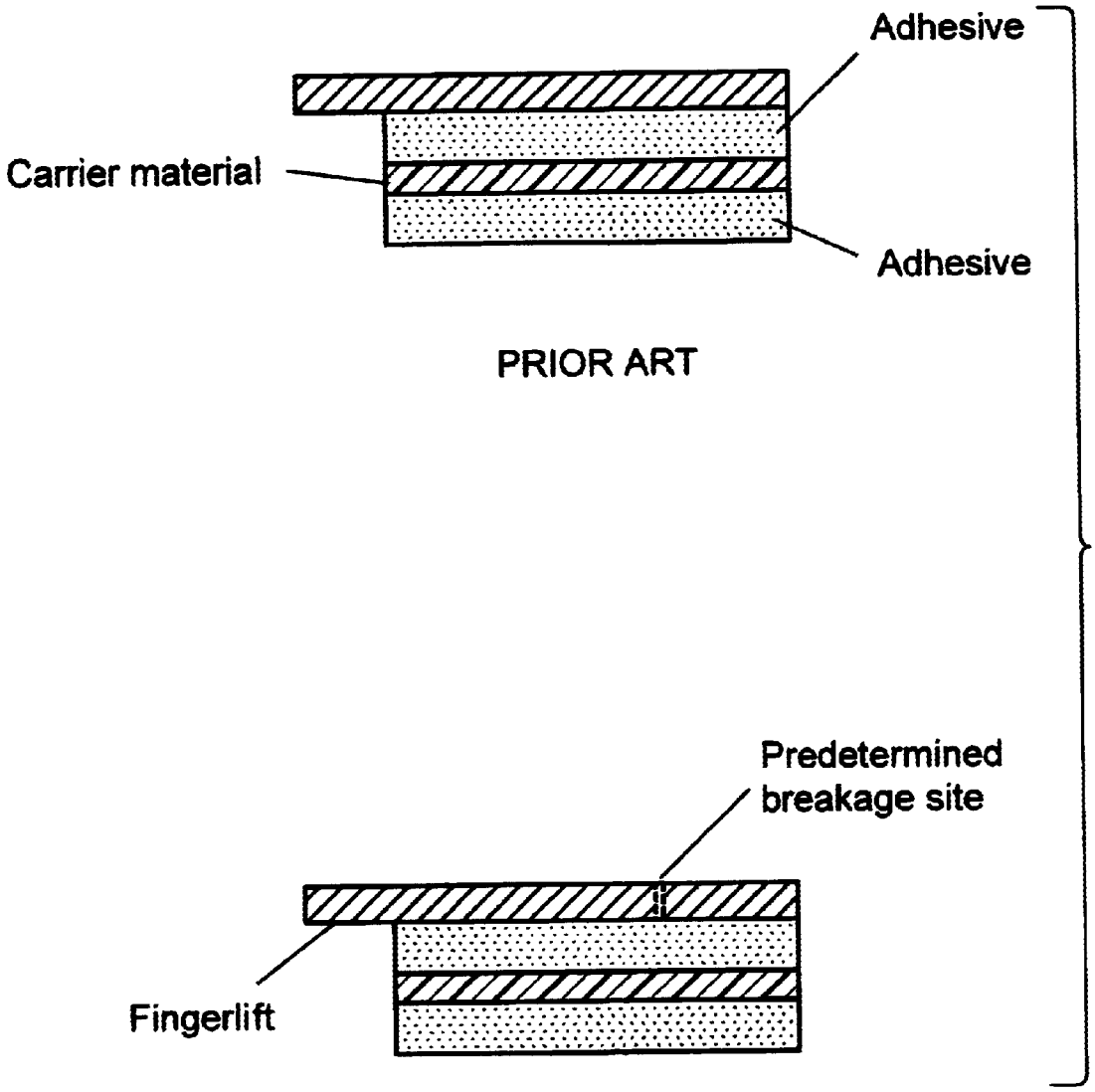

DOUBLE SIDED ADHESIVE TAPE FOR SEALING AND OPENING CARTONS OR CARTONLIKE PACKAGES

The invention relates to the use of a double sided adhesive tape for sealing and opening cartons or cartonlike packages.

With packages made of corrugated card in particular it is a problem to gain access to the contents again in a very simple way after the opening of the package has been stuck down.

The normal way of gaining access is by disruptive cutting or tearing followed by removal of the part of the package that has been broken open. All of these methods are relatively time consuming and, in the case of disruptive cutting and/or tearing in particular, necessitate additional means, such as scissors, knives or keys, for example. Moreover, these means carry with them a risk of injury and/or a risk of damaging the contents.

Also known is the use of tear-open strips, made for example of plastic or in the form of a thin string, with which opening is effected by pulling and, in so doing, separating or tearing the package that is to be opened.

A common feature of all tear-open strips is that their sole purpose is to open the closed carton or package.

The known tear-open strips cannot be used first to seal the package and then to offer a means of opening; in other words, they are not able to constitute simultaneously a means of sealing and a means of opening.

Alternatively, double sided adhesive tapes are offered for secure sealing of a carton, but they do not offer any aid to tearing open.

It is an object of the present invention to provide a sealing tape for cartons or comparable packages which simultaneously offers an aid to opening; in other words, the combination of two hitherto completely separate functions in one solution.

This object is achieved by the use of a double sided adhesive tape for sealing and opening cartons or cartonlike packages, at least one of the two films of adhesive being provided with a nontacky covering in strip form.

The subclaims provide advantageous developments of the subject matter of the invention.

The invention accordingly provides for the use of a double sided adhesive tape for sealing and opening cartons or cartonlike packages, at least one of the two films of adhesive being provided with a nontacky covering in strip form.

The first purpose of the adhesive tape is to seal the carton. For this purpose, the release paper or release film fully covering at least one of the two films of adhesive is partly removed from the film of adhesive to leave, on the film of adhesive, a covering in strip form which additionally is nontacky.

The adhesive tape is applied between two plies or flaps of the carton or of the cartonlike packages, the bonding of the adhesive tape between the two plies or flaps taking place in such a way that the part of the covering which has not been removed from the film of adhesive is likewise situated between the two plies or flaps.

This ensures that the double sidedly adhering adhesive tape first of all connects the two plies or flaps of the carton that form the seal firmly to one another so as to prevent the carton coming undone unintentionally. On the other hand, one part of at least one film of adhesive on the adhesive tape is not tacky as a result of the covering.

It has proven particularly advantageous if 30% of the covering is removed; that is, if, based on the width of the adhesive tape, 70% is nontacky as a result of the remaining covering. Further advantageous values of the covering to be removed are 50% or 70%. It is of course within the expertise of the skilled worker to deviate upward or downward from the stated values if required by the case in hand.

In order to make it easier for the user to remove said one part of the covering, this covering is provided with a predetermined breakage point. This point is preferably brought about by slitting of the release paper.

Furthermore, it may be advantageous to provide the part that is to be removed with an overhanging covering, known as a one-sided fingerlift, in order to make it easier to grasp for the user.

In order to make the tear-open operation even easier, it may also be advantageous to continue the predetermined breakage point into the adhesive tape; in other words, for example, to split the backing material of the adhesive tape as well. As a result, even adhesive tape backing materials of very high tensile strength can be severed reliably during the tear-open process.

In the case of the bonding of two flaps of a carton which are folded over one another, i.e., an upper flap and a lower flap, whose inside edges are each linked to the body of the carton while each of the outer edges extend freely, it should be ensured that the side of the film of adhesive that is provided with the covering is bonded to the upper flap of the carton that is to be bonded, in such a way that it is situated on the side facing away from the outer edge of the upper flap, while the adhesive side of the film of adhesive faces the outer edge of the upper flap of the cardboard packaging. During splitting, then, the upper flap is separated in such a way that the part separated off from the upper flap remains on the lower flap (or, where appropriate, on the carton) so that the formerly bonded upper flap can be folded open.

The adhesive tape can cooperate in two ways with the slit that is preferably present in the ply or plies, or flap or flaps.

First, the ply or flap of the carton, or of the cartonlike packages, against which the covering lies can be slit above the covering. The slit, produced usually by two incisions in the ply or flap, preferably corresponds in its width to approximately the width of the covering.

Secondly, the ply or flap of the carton, or of the cartonlike packages, against which the covering does not lie can be slit above the covering. Here again, the slit, produced normally by means of two incisions in the ply or flap, preferably corresponds in its width to approximately the width of the covering.

Furthermore, preferably, both plies or flaps of the carton or of the cartonlike packages may be slit.

In order to open the carton again ultimately, i.e., to part the two plies or flaps, therefore, there are two advantageous methods.

The film of adhesive of the adhesive tape below the covering is unable to bond to the overlying ply or flap of the carton since the covering prevents this. The unbonded covering therefore forms the first part of a grip tab which is particularly easily gripped if one or two slits are present correspondingly in the ply or plies or in the flap or flaps.

If only one slit is present in the ply or flap, specifically in that ply or flap which lies opposite the covering located on the other side of the adhesive tape, the user grasps the grip tab composed of the covering, the adhesive tape, and the outer cardboard ply. When the grip tab is pulled, the adhesive tape and the ply or flap of the carton that is to be parted are split.

If only one slit is present in the ply or flap, specifically in that ply or flap which lies opposite the covering located on the same side of the adhesive tape, the user grasps the grip tab composed only of the covering and the outer cardboard ply. When the grip tab is pulled, the ply or flap of the carton that is to be parted splits.

The covering is preferably composed of a suitable tensile material, preferably MOPP.

The adhesive tape may be composed of a single layer. In this case it is a carrier free adhesive tape.

Moreover, the carrier layer of the adhesive tape may be formed by films (for example, of PU, PE or PP, polyesters such as PET, PA), nonwovens, wovens, foams, metallized films, composite materials, cotton, laminates, foamed films, paper, etc. It is very advantageous if the carrier layer is easy to tear or part.

A preferred carrier layer is a thermoplastic polyolefin film which is unoriented and includes at least one polyolefin from the group of the polyethylenes (for example, HDPE, LDPE, MDPE, LLDPE, VLLDPE, copolymers of ethylene with polar comonomers) and the group of the polypropylenes (for example, polypropylene homopolymers, random polypropylene copolymers or block polypropylene copolymers). Preference is given to using mixtures of different suitable polyolefins in order to allow optimum setting of the mechanical and thermal properties and also gloss, extrusion behavior, adhesive anchorage, etc.

Materials which lend themselves outstandingly to use as films in accordance with the invention are monoaxially and biaxially oriented films based on polyolefins; films based on oriented polyethylene or oriented copolymers containing ethylene and/or polypropylene units.

Monoaxially oriented polypropylene is notable for its very high tensile strength and low stretch in the lengthwise direction and is used, for example, for producing strapping tapes. Particular preference is given to monoaxially oriented films based on polypropylene.

The thicknesses of the monoaxially oriented films based on polypropylene are preferably between 0.2 and 0.5 mm, in particular between 0.23 and 0.28 mm.

Monoaxially oriented films are primarily single-layer, although multilayer monoaxially oriented films can also be produced in principle. Known films of this kind predominantly comprise single-layer, two-layer and three-layer films, although the number of layers chosen may also be greater.

Additionally, particular preference is given to biaxially oriented films based on polypropylene, with a draw ratio in the machine direction (lengthwise direction; MD) of between 1:4 and 1:9, preferably between 1:4.8 and 1:6, and a draw ratio in the cross direction (transverse direction; CD) of between 1:4 and 1:9, preferably between 1:4.8 and 1:8.5.

Polyesters are polymers whose base building blocks are held together by ester linkages (—CO—O—). In accordance with their chemical structure, those known as homopolyesters can be divided into two groups:

the hydroxy carboxylic acid types (AB polyesters) and the dihydroxy dicarboxylic acid types (AA-BB polyesters).

The former are prepared from only a single monomer by, for example, polycondensation of an ω-hydroxycarboxylic acid 1 or by ring-opening polymerization of cyclic esters (lactones) 2, for example

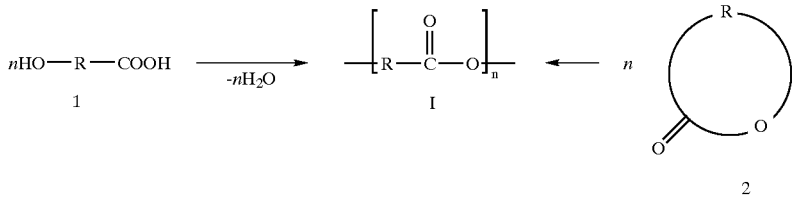

The latter, on the other hand, are synthesized by polycondensation of two complementary monomers, a diol 3 and a dicarboxylic acid 4 for example:

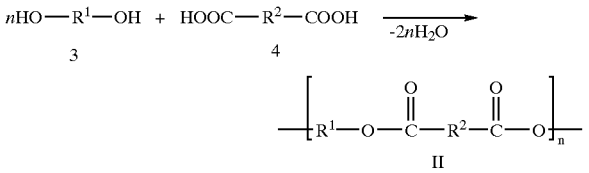

Branched and crosslinked polyesters are obtained in the polycondensation of trihydric or higher polyhydric alcohols with polyfunctional carboxylic acids. The polyesters are generally also considered to include the polycarbonates (polyesters of carbonic acid).

AB type polyesters (I) include polyglycolic acids (polyglycolides, R=CH2), polylactic acids (polylactides, R=CH—CH3), polyhydroxybutyric acid [poly(3-hydroxybutyric acid), R=CH(CH3)—CH2], poly(ε-caprolactone)s [R=(CH2)5] and polyhydroxybenzoic acids (R=C6H4).

Purely aliphatic AA-BB-type polyesters (II) are polycondensates of aliphatic diols and dicarboxylic acids, which are used, inter alia, as products with terminal hydroxyl groups (as polydiols) for the preparation of polyester polyurethanes [for example, polytetramethylene adipate; R1=R2=(CH2)4].

Greatest industrial importance in volume terms is possessed by AA-BB-type polyesters made from aliphatic diols and aromatic dicarboxylic acids, especially the polyalkylene terephthalates [R2=C6H4, with polyethylene terephthalate (PET) R1=(CH2)2, polybutylene terephthalate (PBT) R1=(CH2)4 and poly(1,4-cyclohexanedimethyleneterephthalate)s (PCDT) R1=CH2—C6H10—CH2] as the most important representatives. These types of polyester can be broadly varied in their properties and adapted to different fields of application by using other aromatic dicarboxylic acids (for example, isophthalic acid) and/or by using mixtures of diols in the polycondensation.

Purely aromatic polyesters are the polyarylates, including poly(4-hydroxybenzoic acid) (formula I, R=C6H4), polycondensates of bisphenol A and phthalic acids (formula 11, R1=C6H4—C(CH3)2—C6H4, R2=C6H4) or else those of bisphenols and phosgene.

An example of a suitable carrier layer is a metallocene polyethylene nonwoven.

The metallocene polyethylene nonwoven preferably has the following properties:

a basis weight of from 40 to 200 g/m$^2$, in particular from 60 to 120 g/m$^2$, and/or a thickness of from 0.1 to 0.6 mm, in particular from 0.2 to 0.5, and/or an ultimate tensile stress elongation, MD, of from 400 to 700%, and/or an ultimate tensile stress elongation, CD, of from 250 to 550%.

As carrier material for the adhesive tape it is then possible to use all known textile carriers such as wovens, knits or nonwoven webs; the term "web" embraces at least textile sheetlike structures in accordance with EN 29092 (1988) and also stitchbonded nonwovens and similar systems.

It is likewise possible to use spacer fabrics, including wovens and knits, with lamination. Spacer fabrics of this kind are disclosed in EP 0 071 212 B1. Spacer fabrics are matlike layer structures comprising a cover layer of a fiber or filament fleece, an underlayer and individual retaining fibers or bundles of such fibers between these layers, said fibers being distributed over the area of the layer structure, being needled through the particle layer, and joining the cover layer and the underlayer to one another. As an additional, though not mandatory, feature, the retaining fibers in accordance with EP 0 071 212 B1 comprise inert mineral particles, such as sand, gravel or the like, for example.

The holding fibers needled through the particle layer hold the cover layer and the underlayer at a distance from one another and are joined to the cover layer and the underlayer. Spacer wovens or spacer knits are described, inter alia, in two articles, namely an article from the journal kettenwirk-praxis 3/93, pages 59 to 63, "Raschelgewirkte Abstandsgewirke" [Raschel-knitted spacer knits]

and an article from the journal kettenwirk-praxis 1/94, pages 73 to 76, "Raschelgewirkte Abstandsgewirke", the content of said articles being included here by reference and being part of this disclosure and invention.

Suitable nonwovens include, in particular, consolidated staple fiber webs, but also filament webs, meltblown webs, and spunbonded webs, which generally require additional consolidation. Known consolidation methods for webs are mechanical, thermal and chemical consolidation. Whereas with mechanical consolidations the fibers are held together purely mechanically, usually by entanglement of the individual fibers, by the interlooping of fiber bundles or by the stitching-in of additional threads, it is possible by thermal and by chemical techniques to obtain adhesive (with binder) or cohesive (binderless) fiber-fiber bonds. Given appropriate formulation and an appropriate process regime, these bonds may be restricted exclusively, or at least predominantly, to the fiber nodal points, so that a stable, three-dimensional network is formed while retaining the loose, open structure in the web.

Webs which have proven particularly advantageous are those consolidated in particular by overstitching with separate threads or by interlooping.

Consolidated webs of this kind are produced, for example, on stitchbonding machines of the "Mali fleece" type from the company Karl Meyer, formerly Malimo, and can be obtained, inter alia, from the companies Naue Fasertechnik and Techtex GmbH. A Mali fleece is characterized in that a cross-laid web is consolidated by the formation of loops from fibers of the web.

The backing used may also be a web of the Kunit or Multiknit type. A Kunit web is characterized in that it originates from the processing of a longitudinally oriented fiber web to form a sheetlike structure which has the heads and legs of loops on one side and, on the other, loop feet or pile fiber folds, but possesses neither threads nor prefabricated sheetlike structures. A web of this kind has been produced, inter alia, for many years, for example on stitchbonding machines of the "Kunitvlies" type from the company Karl Meyer. A further characterizing feature of this web is that, as a longitudinal-fiber web, it is able to absorb high tensile forces in the longitudinal direction. The characteristic feature of a Multiknit web relative to the Kunit is that the web is consolidated on both the top and bottom sides by virtue of the double-sided needle punching.

Finally, stitchbonded webs are also suitable as an intermediate for forming an adhesive tape of the invention. A stitchbonded web is formed from a nonwoven material having a large number of stitches extending parallel to one another. These stitches are brought about by the incorporation, by stitching or knitting, of continuous textile threads. For this type of web, stitchbonding machines of the "Maliwatt" type from the company Karl Mayer, formerly Malimo, are known.

Also particularly advantageous is a staple fiber web which is mechanically preconsolidated in the first step or is a wet-laid web laid hydrodynamically, in which between 2% and 50% of the web fibers are fusible fibers, in particular between 5% and 40% of the fibers of the web. A web of this kind is characterized in that the fibers are laid wet or, for example, a staple fiber web is preconsolidated by the formation of loops from fibers of the web or by needling, stitching or air-jet and/or water-jet treatment.

In a second step, thermofixing takes place, with the strength of the web being increased again by the (partial) melting of the fusible fibers.

The web backing may also be consolidated without binders, by means for example of hot embossing with structured rollers, with properties such as strength, thickness, density, flexibility, and the like being controllable via the pressure, temperature, residence time, and embossing geometry.

For the inventive use of nonwovens, the adhesive consolidation of mechanically preconsolidated or web-laid webs is of particular interest, it being possible for said consolidation to take place by way of the addition of binder in solid, liquid, foamed or paste-like form. A great diversity of theoretical embodiments is possible: for example, solid binders as powders for trickling in; as a sheet or as a mesh, or in the form of binding fibers. Liquid binders may be applied as solutions in water or organic solvent or as a dispersion. For adhesive consolidation, binder dispersions are predominantly chosen: thermosets in the form of phenolic or melamine resin dispersions, elastomers as dispersions of natural or synthetic rubbers, or, usually, dispersions of thermoplastics such as acrylates, vinyl acetates, polyurethanes, styrene-butadiene systems, PVC, and the like, and also copolymers thereof. Normally, the dispersions are anionically or nonionically stabilized, although in certain cases cationic dispersions may also be of advantage.

The binder may be applied in a manner which is in accordance with the prior art and for which it is possible to consult, for example, standard works of coating or of nonwoven technology such as "Vliesstoffe" (Georg Thieme Verlag, Stuttgart, 1982) or "Textiltechnik-Vliesstofferzeugung" (Arbeitgeberkreis Gesamttextil, Eschborn, 1996).

For mechanically preconsolidated webs which already possess sufficient composite strength, the single-sided spray application of a binder is appropriate for effecting specific changes in the surface properties.

Such a procedure is not only sparing in its use of binder but also greatly reduces the energy requirement for drying. Since no squeeze rolls are required and the dispersion remains predominantly in the upper region of the web material, unwanted hardening and stiffening of the web can very largely be avoided.

For sufficient adhesive consolidation of the web backing, the addition of binder in the order of magnitude of from 1% to 50%, in particular from 3% to 20%, based on the weight of the fiber web, is generally required.

The binder may be added as early as during the manufacture of the web, in the course of mechanical preconsolidation, or else in a separate process step, which may be carried out in line or off line. Following the addition of a binder it is necessary temporarily to generate a condition in which the binder becomes adhesive and adhesively connects the fibers—this may be achieved during the drying, for example, of dispersions, or else by heating, with further possibilities for variation existing by way of areal or partial application of pressure. The binder may be activated in known drying tunnels, or else, given an appropriate selection of binder, by means of infrared radiation, UV radiation, ultrasound, high-frequency radiation or the like. For the subsequent end use it is sensible, although not absolutely necessary, for the binder to have lost its tack following the end of the web production process.

A further, special form of adhesive consolidation consists in activating the binder by incipient dissolution or swelling. In this case it is also possible in principle for the fibers themselves, or admixed special fibers, to take over the function of the binder. Since, however, such solvents are objectionable on environmental grounds, and/or are problematic in their handling, for the majority of polymeric fibers, this process is not often employed.

Starting materials envisaged for the textile backing include, in particular, polyester, polypropylene, viscose or cotton fibers. The present invention is, however, not restricted to said materials; rather it is possible to use a large number of other fibers to produce the web, as is evident to the skilled worker without any need for inventive activity.

Knitted fabrics are produced from one or more threads or thread systems by intermeshing (interlooping), in contrast to woven fabrics, which are produced by intersecting two thread systems (warp and weft threads), and nonwovens (bonded fiber fabrics), where a loose fiber web is consolidated by heat, needling or stitching or by means of water jets.

Knitted fabrics can be divided into weft knits, in which the threads run in transverse direction through the textile, and warp knits, where the threads run lengthwise through the textile. As a result of their mesh structure, knitted fabrics are fundamentally pliant, conforming textiles, since the meshes are able to stretch lengthways and widthways, and have a tendency to return to their original position. In high-grade material, they are very robust.

It is of very great importance for the carrier material overall that it can be split in the lengthwise direction, i.e., in the running direction of the adhesive tape. In this way it is possible for the covering in strip form to sever the carrier material in order subsequently to tear open, for example, the cardboard plies of the carton.

It is also very advantageous if the two adhesives located either side of the carrier material are also splittable.

As a self-adhesive composition use is made in particular of a commercially customary, pressure sensitive adhesive based on PU, acrylate or rubber.

An adhesive which has proven particularly advantageous is one based on acrylate hotmelt having a K value of at least 20, in particular more than 30, obtainable by concentrating a solution of such a composition to give a system which can be processed as a hotmelt. Concentration may take place in appropriately equipped tanks or extruders; particularly in the case of accompanying devolatilization, a devolatilizing extruder is preferred.

An adhesive of this kind is set out in DE 43 13 008 A1, whose content is hereby referenced and is part of this disclosure and invention. In an intermediate step, the solvent is removed completely from the acrylate compositions prepared in this way.

In addition, further volatile constituents are removed. After coating from the melt, these compositions contain only small fractions of volatile constituents. Accordingly, it is possible to adopt all of the monomers/formulas claimed in the above-cited patent. A further advantage of the compositions described in the patent is that they have a high K value and thus a high molecular weight. The skilled worker is aware that systems with relatively high molecular weights may be crosslinked more efficiently. Accordingly, there is a corresponding reduction in the fraction of volatile constituents.

The solution of the composition may contain from 5 to 80% by weight, in particular from 30 to 70% by weight, of solvent.

It is preferred to use commercially customary solvents, especially low-boiling hydrocarbons, ketones, alcohols and/or esters.

Preference is further given to using single-screw, twin-screw or multiscrew extruders having one or, in particular, two or more devolatilizing units.

The adhesive based on acrylate hotmelt may contain copolymerized benzoin derivatives, such as benzoin acrylate or benzoin methacrylate, for example, acrylates or methacrylates. Benzoin derivatives of this kind are described in EP 0 578 151 A1.

The adhesive based on acrylate hotmelt may alternatively be chemically crosslinked. In one particularly preferred embodiment, self-adhesive compositions used comprise copolymers of (meth)acrylic acid and esters thereof having from 1 to 25 carbon atoms, maleic, fumaric and/or itaconic acid and/or their esters, substituted (meth)acrylamides, maleic anhydride, and other vinyl compounds, such as vinyl esters, especially vinyl acetate, vinyl alcohols and/or vinyl ethers.

The residual solvent content should be below 1% by weight.

One adhesive indicated as particularly suitable is a low molecular mass, pressure sensitive acrylic hotmelt adhesive, such as that carried under the designation acResin UV or Acronal®, especially Acronal DS 3458, by BASF. This low-K adhesive acquires its application-oriented properties as a result of a final, radiation-chemically initiated crosslinking process.

Finally, if the matrix is not present over the full area of the backing material, the matrix and/or the backing material coated with the adhesive may be lined with the customary release paper.

The intention of the text below is to illustrate the invention with reference to a number of figures, without wishing thereby to subject the invention to any unnecessary restrictions.

Figure 2:
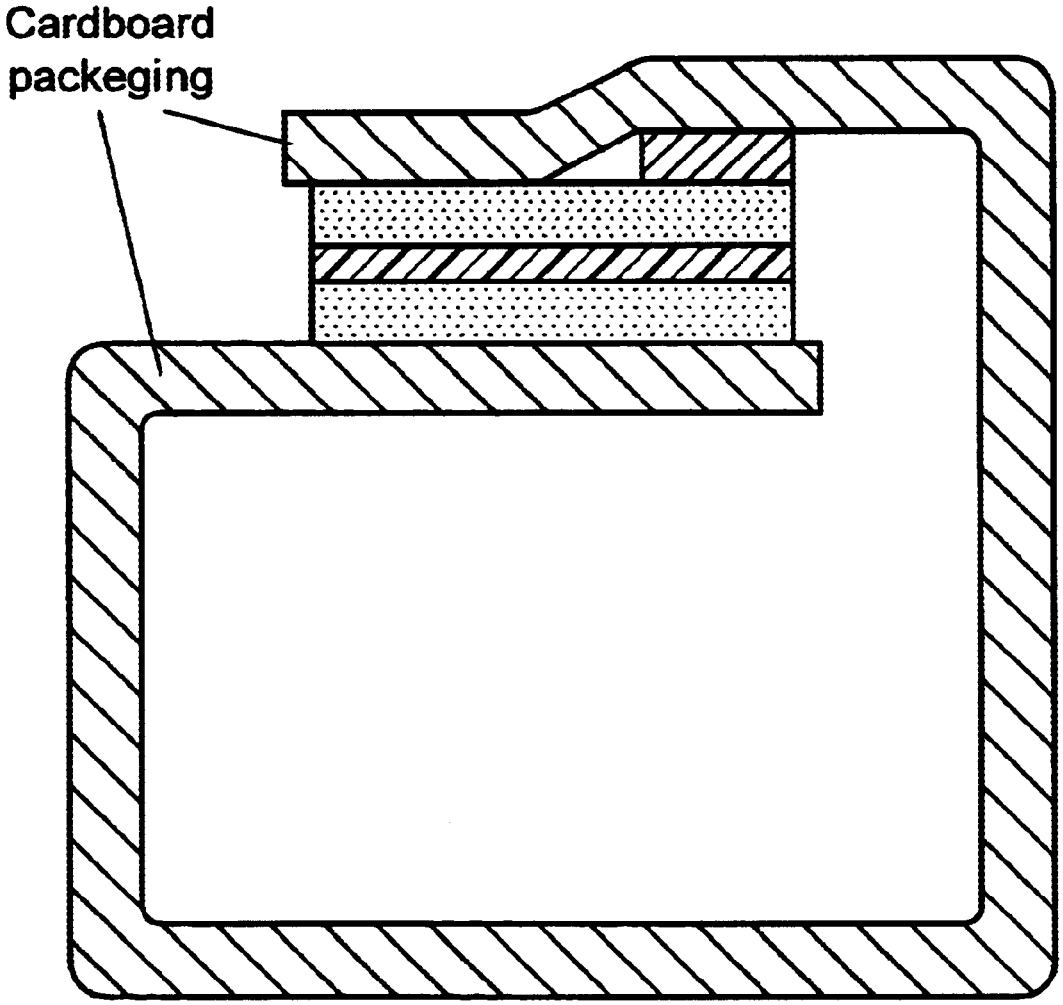
Figure 3:
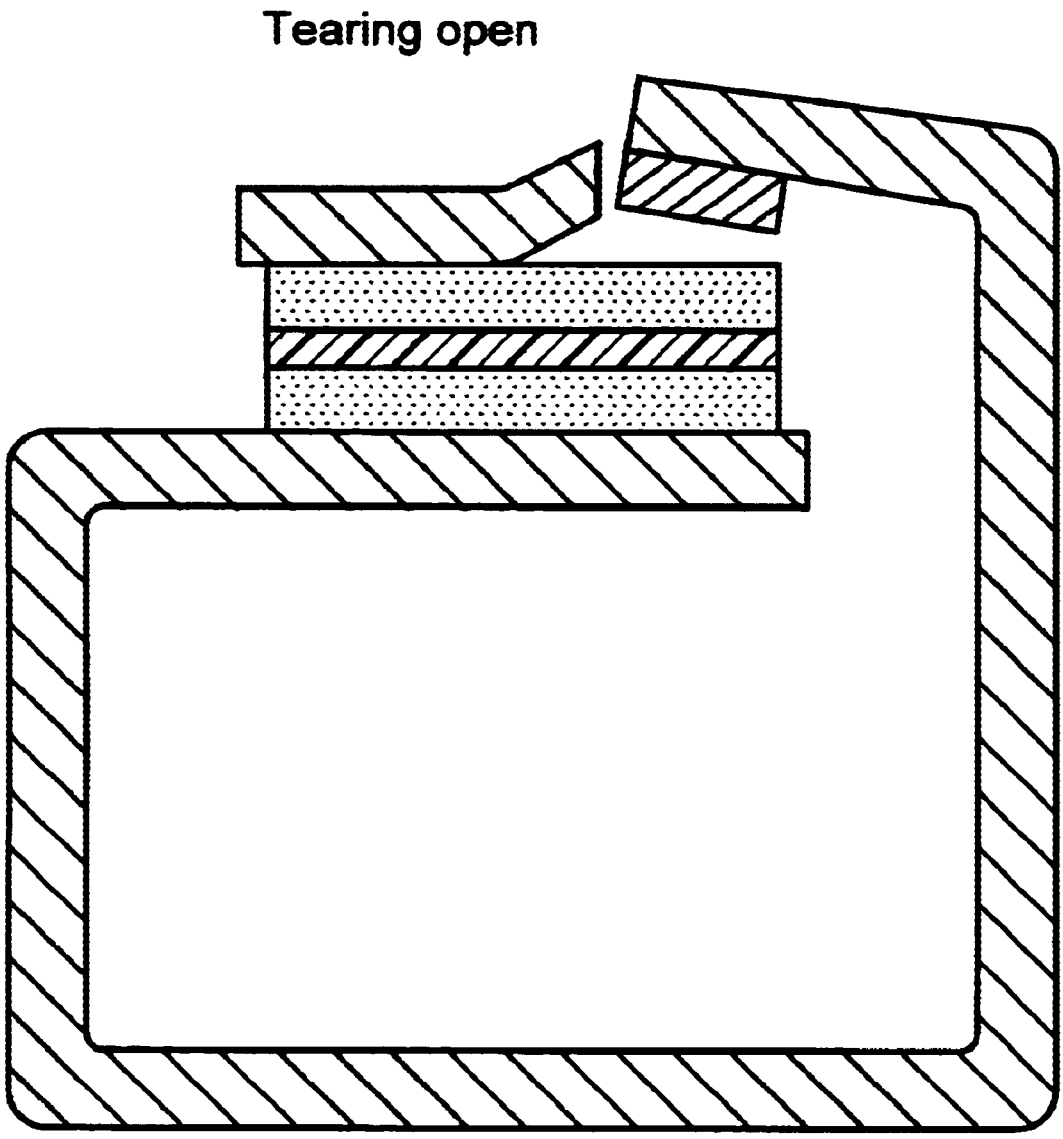

FIG. 1 shows a double sided adhesive tape as used in the prior art for sticking cartons, and a double sided adhesive tape of the invention with slitted covering for sealing and opening cartons or cartonlike packages, FIG. 2 shows the double sided adhesive tape shown in FIG. 1 in the course of its use as a sealing tape for a carton, and FIG. 3 shows the double sided adhesive tape shown in FIG. 1 in the course of its use as an opening aid for a carton.

FIG. 1 shows on the one hand a double sided adhesive tape as used in the prior art for sticking cartons, and on the other a double sided adhesive tape of the invention with slitted covering for sealing and opening cartons or cartonlike packages.

The adhesive tape is composed of a carrier layer provided on both top and bottom sides with an adhesive coating. On the top adhesive layer there is a covering. The adhesive tape of the invention is distinguished by the fact that one of the two adhesive layers of the double sided adhesive tape, namely the top layer, is covered with a non-adhesive covering, this covering being slitted, so that when sticking a carton one part of the covering can be peeled off and the other part of the covering can remain on the adhesive.

Additionally, the part of the covering that does not remain on the adhesive layer has the particular feature that the covering extends beyond the adhesive tape; in other words, the width of the overall split covering is greater than the width of the carrier material of the adhesive tape.

This produces a grip tab, called a fingerlift, which can easily be grasped by the user. The removal of the covering is made very much easier.

FIG. 2 shows the double sided adhesive tape in the course of its use as a sealing tape for a carton, shown in a highly stylized sectional view from the side. In order to stick the adhesive tape between two plies of the carton, part of the nonadhesive covering is removed from the adhesive layer, and the adhesive tape is stuck between the two plies of the carton or of the cartonlike packages in such a way that the part of the covering that has not been removed from the adhesive layer is likewise situated between the two plies.

Accordingly, sealing of the carton is secured by virtue of the fact that the free part of the upper adhesive layer is firmly bonded to the upper ply of the carton and at the same time the entire bottom adhesive layer sticks to the bottom ply of the carton. Above the covering which has remained on the top adhesive layer, the carton is open.

Bonding has taken place in such a way that the side of the adhesive layer provided with the covering is stuck on the upper flap of the carton in such a way that it lies on the side facing away from the outer edge of the flap, whereas the adhesive side of the adhesive layer points toward the outer edge of the flap of the cardboard packaging.

In FIG. 3, the double sided adhesive tape of the invention shown in FIG. 1 is depicted in the course of its use as an opening aid for a carton. The carton is torn open by pulling on the covering, which leads to the splitting of the top ply of the carton.

In the course of splitting, the flap is separated in such a way that the part separated from the flap remains on the other flap, so that the formerly stuck flap can be opened.

What is claimed is:

1. Method of sealing and opening a carton or a package using a double-sided adhesive tape comprising:

a) providing a carton or a package with overlapping plies or flaps;

b) providing a double-sided adhesive tape wherein at least one side of the adhesive tape is provided with a non-tacky covering;

c) removing part of the covering from the adhesive tape and exposing a portion of the adhesive; and d) bonding the portion between overlapping plies or flaps, such that a part of the covering which has not been removed from the adhesive tape is situated between the overlapping plies or laps.

2. Method as claimed in claim 1, wherein the covering has a predetermined breakage point.

3. Method as claimed in claim 2, wherein the predetermined breakage point is designed as a slit.

4. Method as claimed in claim 1, wherein the part of the covering that is to be removed overhangs on one side of the adhesive tape.

5. Method as claimed in claim 4, wherein the part of the covering that is to be removed has a greater width than the adhesive tape.

6. Method as claimed in claim 1, wherein the part of the covering that is to be removed occupies 30% of the width of the adhesive tape.

7. Method as claimed in claim 1, wherein the adhesive tape comprises a carrier material which is weakened.

8. Method as claimed in claim 7, wherein the carrier material is weakened by splitting the carrier material.

9. Method as claimed in claim 1, wherein a ply or flap of the carton or of the package against which the covering lies contains a slit above the covering.

10. Method as claimed in claim 1, wherein a ply or flap of the carton or of the package against which the covering does not lie contains a slit above the covering.

11. Method as claimed in claim 1, wherein overlapping plies or flaps of the carton or of the package contain slits above the covering.

12. Method as claimed in claim 1, wherein the covering is composed of a tensile material.

13. Method as claimed in claim 12, wherein the tensile material is MOPP.

14. Method as claimed in claim 1, wherein the adhesive tape comprises a backing material which is composed of a material which is easy to part.

15. Method as claimed in claim 14, wherein the material which is easy to part is PET.

* * * * *

UNITED STATES PATENT AND TRADEMARK OFFICE

CERTIFICATE OF CORRECTION

PATENT NO. : 6,689,244 B2
DATED : February 10, 2004
INVENTOR(S) : Schwertfeger

It is certified that error appears in the above-identified patent and that said Letters Patent is hereby corrected as shown below:

Drawings,
Figure 2, “packcging” should read -- packaging --.

Signed and Sealed this

Twenty-eighth Day of September, 2004

JON W. DUDAS
*Director of the United States Patent and Trademark Office*